US005501464A

United States Patent [19]

Dalbo

[11] Patent Number: 5,501,464

[45] Date of Patent: Mar. 26, 1996

[54] GOLF SWING FOREARM/WRIST POSITIONER

[75] Inventor: Leo Dalbo, Sebastopol, Calif.

[73] Assignee: Dalme, Inc., Bloomfield Hills, Mich.

[21] Appl. No.: 413,612

[22] Filed: Mar. 30, 1995

[51] Int. Cl.[6] ..... A63B 69/36

[52] U.S. Cl. ..... 273/187.2; 273/189 R

[58] Field of Search ..... 273/189 R, 187.2; 434/252

[56] References Cited

U.S. PATENT DOCUMENTS

| | | | |
|---|---|---|---|
| 1,655,092 | 1/1928 | Davis | 273/189 R |
| 3,804,420 | 4/1974 | Boyd | 273/191 B X |
| 4,134,589 | 1/1979 | Arena | 273/191 B X |
| 4,209,169 | 6/1980 | Roberts | 273/29 A |
| 4,239,228 | 12/1980 | Norman et al. | 273/189 R |
| 4,273,336 | 6/1981 | Larkey | 273/189 R |
| 4,445,686 | 5/1984 | Daugherty | 273/29 A |
| 4,662,640 | 5/1987 | Grander | 273/191 B X |
| 4,944,516 | 7/1990 | Bickler | 273/194 R X |
| 5,040,798 | 8/1991 | Leitao | 273/189 R X |
| 5,060,942 | 10/1991 | Dalbo | 273/187.2 X |
| 5,145,179 | 9/1992 | Breed | 273/189 R |
| 5,203,568 | 4/1993 | Vasquez | 273/189 R X |
| 5,203,570 | 4/1993 | Graham | 273/187.2 |
| 5,259,621 | 11/1993 | Keefer | 273/189 R X |

OTHER PUBLICATIONS

"Five Lessons The Modern Fundamentals of Golf", published in 1957 by Simon & Schuster, Inc., New York.

*Golf*, pp. 82, 83, Nov., 1989.

*Primary Examiner*—George J. Marlo

*Attorney, Agent, or Firm*—Reising, Ethington, Barnard & Perry

[57] ABSTRACT

A forearm/wrist positioner for maintaining a predetermined triangular relationship between the forearms and elbows of a trainee as the trainee swings a golf club from the address position, to the backswing, downswing, and follow-through positions and which includes at least one cuff member adapted to be mounted on one of the forearms and secured to one end of a spacer member the other end of which is pressed by the latter mentioned forearm against the other forearm for maintaining a predetermined distance between the elbows and forearms of the trainee as the latter swings a golf club from the address position through the follow-through position.

9 Claims, 3 Drawing Sheets

GOLF SWING FOREARM/WRIST POSITIONER

This invention concerns training devices and most particularly relates to a training device for maintaining a predetermined triangular relationship between the forearms and wrists of the leading arm and the trailing arm of a golf trainee.

BACKGROUND OF THE INVENTION

Various types of training devices have been proposed for developing a proper swing of a golf club. Representative examples of such devices can be seen U.S. Pat. No. 4,134,589 issued Jan. 16, 1979 (a device for preventing head lift during swinging); U.S. Pat. No. 3,804,420 issued Apr. 16, 1974 (an elbow swing control device to prevent casing of the elbow during the backswing); U.S. Pat. No. 4,662,640 issued May 5, 1987 (a harness provided with suspending means adapted to impart to the user a feel for correct swing fundamentals); and U.S. Pat. No. 5,203,570 issued Apr. 20, 1993 (a continuous elastic band which is intended to provide arm straightening assistance during the golf club swing).

In addition, I have proposed various forms of golf training devices which can be seen in my U.S. Pat. No. 5,060,942 issued on Oct. 29, 1991 and in my U.S. Pat. No. 5,451,060, issued on Sep. 19, 1995.

The above-mentioned patent which issued in my name is directed to a training device for training a user of a golf club in which the training device is connected between the golf club and the body of the user to act as a constraint on the path of movement of the golf club. The training device is characterized by a flexible triangular guide member having an apex portion defining a golf club end and a base portion defining a body engaging end. The golf club end is connected to the handle of the golf club and the base portion includes upper and lower ends connected at vertically spaced points to the user's torso such that the triangular guide member lies in a vertical plane parallel to the axis of rotation of the user's body in its unobstructed condition.

My patent application which is mentioned above discloses a golf trainee body harness used with a golf club for increasing the consistency of the golf swing. The body harness includes a closed loop of flexible inelastic material adapted to receive the trailing arm of the trainee and wrap around the shoulder and extend along the back of the trainee in the form of a "V". The apex of the "V" is located at a point below the arm pit and below the other shoulder of the trainee, and a strap fabricated from a flexible inelastic material has a first end and a second end, one end of which is held by the leading hand of the trainee together with the handle of the golf club. The other end of the strap is secured to the closed loop at the apex thereof so as the golf club is rotated through a complete swing, the closed loop and the strap provide a total restraint of the swing to develop a consistent swing of the golf club.

Although I have found that the golf training devices disclosed in my above-identified patent and patent application serve to improve the overall golf swing of a trainee, further experimentation and development on my part have proven to me that it is also important to maintain a predetermined triangular relationship between the forearms and the wrists of the trainee in order to develop an effective golf swing.

As is well known, and has been expressed by Tommy Armour in his book entitled "How to Play Your Best Golf All the Time", the game of golf is played using two arms. The leading arm guides the club and keeps the face of the club in the desired position for the hit, and the force of the impact is realized through the coupling of the trailing arm and the club. The trailing arm effectively contributes to the entire club swing by reinforcing and bracing the swinging action of the club and converts it into a more rigid composite lever with both arms working together. In addition, the two arms of the player add both control and sensitivity to the clubhead action through the ball and also provide additional clubhead speed into impact by enabling the player to power his wrist action around the center of the swing. Thus, it is clear that in order to have an effective golf swing, the hands and the arms must work together to realize the utmost leverage, balance, precision and speed that can be applied to the ball through the golf club.

SUMMARY OF THE INVENTION

I have found that a golf trainee can improve his swing with one of the golf training devices (which can be referred to as a "primary strap") seen in my patent and patent application when combined with the forearm/wrist positioner according to the present invention. When addressing the ball, the primary strap serves to establish the correct angle for the direction of ball flight and serves to establish the radius of swing. At the same time, the forearm/wrist positioner will establish the correct triangular relationship of the arms and the initial plane of swing.

When the golf club is moved by the trainee from the address position to the backswing position, the primary strap will force body rotation by pulling forwardly on the leading arm's shoulder and pulling rearwardly on the trailing arm's shoulder and will help keep the leading arm forearm straight and maintain the correct radius. The forearm/wrist positioner continues to maintain the correct triangular relationship of the arms and creates a one-piece takeaway with the primary strap while assisting in a more upright plane of swing.

During downswing of the golf club, the primary strap maintains the correct radius of swing. The forearm/wrist positioner continues to maintain the preset triangular relationship of the arms to the point of contact with the ball and tends to help increase the trailing arm's impact with the ball while maintaining better control of the club head. After impact with the ball and during follow-through, the primary strap serves to maintain radius of the swing while the forearm/wrist positioner provides feedback to maintain arm relationship to further assist the body rotation to complete the swing.

I have also found that where a golf trainee has a relatively good swing but needs improvement in the positions of the arms and elbows, the forearm/wrist positioner can be used by the trainee without utilizing a primary strap as described above.

Accordingly, an object of the present invention is to provide a new and improved golf training device which helps maintain a predetermined relationship between the forearms and wrists of a golf trainee for improving the golf swing.

Another object of the present invention is to provide a new and improved training golf device which includes a spacer member that is connected to one of the forearms and contacts the other forearm of a golf trainee for maintaining a correct relationship therebetween as the golf trainee swings the golf club from the address position through the backswing, downswing and follow-through positions.

A further object of the present invention is to provide a new and improved golf swing training device which includes a primary strap that is adapted to be positioned on the torso of the golf trainee and combined with a forearm/wrist positioner which serves to maintain a predetermined relationship of the arms during the address position through the backswing, downswing and follow-through positions for developing an improved golf swing.

A still further object of the present invention is to provide a new and improved golf swing training device which includes a primary strap and a forearm/wrist positioner and wherein the primary strap has one end thereof formed as a closed loop adapted to have the trailing arm extend therethrough and wrap around the shoulder with the other end of the primary strap being connected to the handle of the golf club and wherein the forearm/wrist positioner includes a cuff member secured to one of the forearms and combined with a relatively rigid spacer member which extends towards and is secured to a similar cuff member located on the other forearm of the trainee.

Other objects and advantages of the present invention will be apparent to those skilled in the art from a reading of the following detailed description when taken with the drawings in which:

DETAILED DESCRIPTION OF THE DRAWINGS

Figure 1:
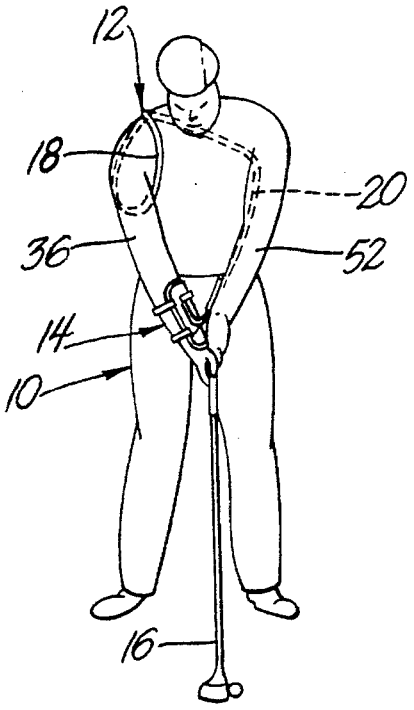
FIG. 1 is a front view of a golf trainee addressing a golf ball and having a golf swing training device mounted on his upper torso and utilizing one form of a forearm/wrist positioner made in accordance with the present invention.

Referring to the drawings and more particularly FIGS. 1 through 4 thereof, a golf trainee 10 is shown having a golf swing training device 12 mounted on the upper torso of the trainee's body and a forearm/wrist positioner 14 made in accordance with the present invention.

The golf swing training device 12 is connected between the body of the trainee 10 and a golf club 16 which is held by the two hands of the trainee 10. As described in my patent application and my issued patent both of which are mentioned above, the golf swing training device 12 acts as a constraint on the path of movement of the golf club as the trainee swings the golf club 16 from the address position seen in FIG. 1 through the backswing, downswing and follow-through positions.

Figure 12:
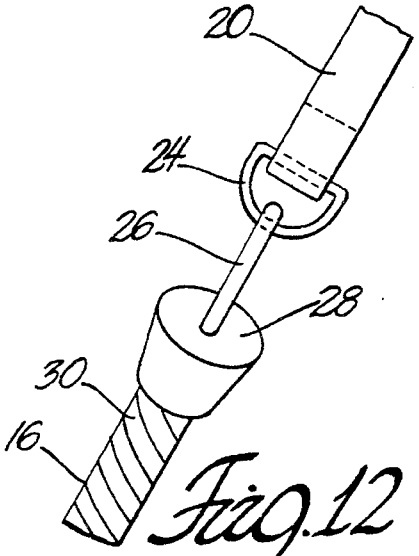
FIG. 12 shows the type of connection provided between the outer end of the golf swing training device mounted on the torso of the golf trainee seen in FIGS. 1–4 and FIGS. 5–8.

In this instance, the golf swing training device 12 includes a shoulder member 18 which takes the form of a closed loop of elastomeric material and a strap member 20 which is made of a flexible inelastic material. More specifically, the shoulder member 18 is mounted onto the upper torso of the golf trainee so that the trailing arm extends through the closed loop in a manner whereby a lower portion of the member 18 is positioned below the arm pit while an upper portion of the member 18 rests on the shoulder of the trainee 10 as seen in FIG. 1. The strap member 20, made of a flexible but inelastic material, is connected at one end to the shoulder member 18 at a point 22 and extends along the upper back of the trainee 10 for connection at the other end with a "D" shaped metal ring 24 as seen in FIG. 12. The ring 24, in turn, is secured to one end of an elastic cord 26 the opposite end of which is centrally secured to a cup-shaped member 28 made of elastomeric material. The cup-shaped member 28 is adapted to be snugly fitted onto the end of the handle 30 of the golf club 16.

Although not shown, it will be understood that the length of the strap member 20 of the golf swing training device can be adjusted so as to allow it to be used with golf trainees of varying stature. The important consideration being that once the golf swing training device 12 is mounted on the trainee 10, the strap member 20 is taut when the trainee 10 assumes the address position seen in FIG. 1.

Figure 3:
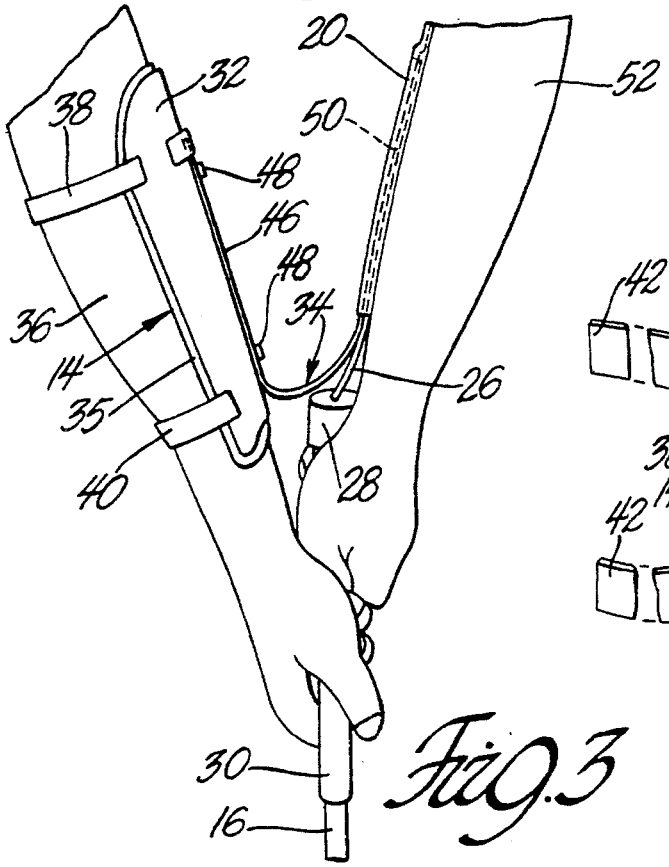
FIG. 3 is an enlarged view of the lower part of the arms of the golf trainee seen in FIG. 1 showing more clearly the manner that the forearm/wrist positioner is connected to the forearm of the trailing arm.
Figure 4:
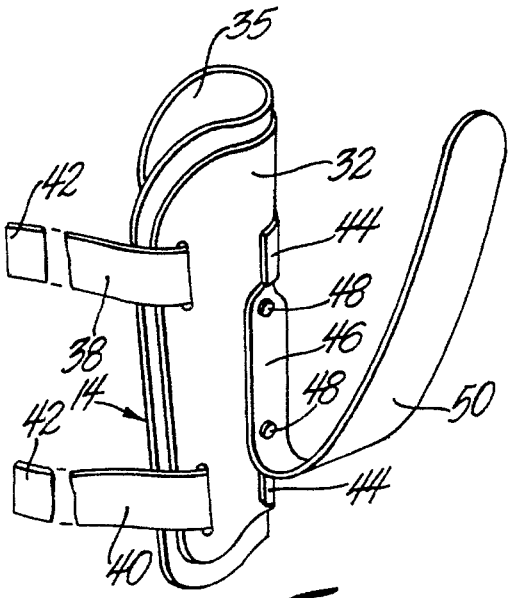
FIG. 4 is a perspective view of the forearm/wrist positioner seen in FIGS. 1–3.

As seen in FIGS. 3 and 4, the forearm/wrist positioner 14 comprises a cuff member 32 and a spacer member 34. The cuff member 32 is semi-cylindrical in shape and can be molded from a plastic material to fit the tapered form of the forearm of the trailing arm 36 of the trainee 10. A liner 35, made of felt or a similar cushioning material is fitted to the inner surface of the cuff member 32 and conforms in shape therewith. A pair of elastic straps 38 and 40 serve to hold the cuff member 32 on the trainee's forearm. Each of the straps 38 and 40 is secured at one end to one side of the cuff member 32 and the free end of each of the straps 38 and 40 is provided with a VELCRO hook portion 42 for securement with opposed VELCRO loop portions 44 located on the other side of the cuff member 32.

The spacer member 34 is formed of a malleable metal material which is of a generally "V" configuration. The spacer member 34 is of a thickness which will allow the "V" configuration to be adjusted angularly when sufficient force is applied, however, once the angle is attained, the "V" configuration will maintain its preset angle while being used by the trainee 10. As best seen in FIG. 4, one leg 46 of the spacer member 34 is rigidly secured by rivets 48 or the like positioned along its longitudinal axis to the midsection of the cuff member 32. In the preferred form, the longitudinal axis of the leg 46 is aligned in the same plane with the longitudinal center axis of the cuff member 32 as seen in FIG. 4.

As seen in FIG. 3, the other leg 50 of the spacer member 34 extends outwardly from the cuff member 32 and is connected to the lower end of the strap member 20 of the golf swing training device 12. In this instance, the lower end of the strap member 20 is provided with a sheath type pocket (not shown) into which the leg 50 extends. Any other form of connection between the leg 50 of the spacer member 34 and the strap member 20 can be provided so long as the two are coupled together for reasons which will now be explained.

Figure 2:
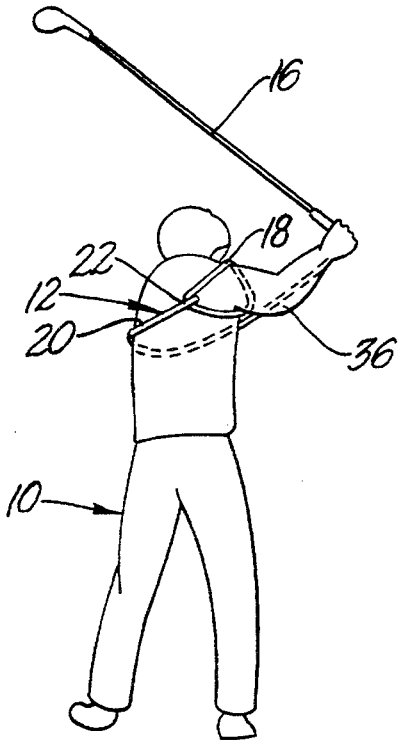
FIG. 2 is a back view of the golf trainee of FIG. 1 with the golf club raised to the backswing position.

In operation, once the golf swing training device 12 and the forearm/wrist positioner 14 are mounted on the trainee 10 as described above, the lower end portion of the strap member 20 will lie along and in contact with the inner forearm of the leading arm 52 of the trainee 10. As a result, the preset angled spacer member 34, being connected to the forearm of the trailing arm 36 and having its leg 50 located in the lower end of the strap member 20, establishes the relative spacing of the forearms as well as the elbows of the trainee 10. At address, the trainee 10 will move his/her elbows inwardly causing the leg 50 to move the lower end of the strap member 20 into contact with the forearm of the leading arm 52. The angle between the legs 46 and 50 of the spacer member 34 will then set the spacing distance between the forearms and elbows of the trainee 10. This position of the elbows will then be maintained by the trainee from address through follow-through. During takeaway, the strap member 20 will tend to pull on the shoulder member 18 and cause the latter to stretch as seen in FIG. 2. At the same time, the lower end of the strap member 20 will move in contact with the forearm of the leading arm 52 permitting the preset spacing of the forearms and the elbows to be maintained by the forearm/wrist positioner 14.

As has been pointed out in an article on pages 82 and 83 of *GOLF*, November 1989, a flying trailing arm elbow leads to disaster for most golfers. This article indicates that a trailing arm elbow that extends too far from the body on the backswing results in a violent slice, and that the trailing arm elbow should point generally down during the backswing and the forearm of the trailing arm must never get as high as parallel to the ground. This article further indicates that the position of the leading arm elbow during the downswing influences the swing path and the position of the club at impact, and that the leading arm elbow, like the trailing arm right elbow, should point generally towards the ground and that it will stay closer to one's side and point downward if one begins the downswing by gently pulling on the golf handle from the top of the backswing.

The above golf swing instructions set forth in GOLF magazine concludes with the observation that both elbows will stay in the desired positions if one keeps them approximately the same distance from each other from address through follow-through. "Achieve this and the golfer's swing will be in control" is the statement made in this regard.

The importance of maintaining the same distance between the elbows from address through follow-through is also emphasized by Ben Hogan in his classic book entitled "Five Lessons The Modern Fundamentals of Golf", published in 1957 by Simon & Schuster, Inc., New York. On page 48 of that book, Mr. Hogan states "The elbows should be tucked in, not stuck out from the body. At address, the left elbow should point directly at the left hipbone and the right elbow should point directly at the right hipbone. Furthermore, there should be a sense of fixed jointness between the two forearms and the wrists, and it should be maintained throughout the swing.".

Accordingly, in order to train a golfer to achieve the "fixed jointness" between the elbows and wrists and maintain both elbows at approximately the same distance, I have provided the forearm/wrist positioner 14 which will preset the spacing of the forearms and wrists of the golf trainee and maintain the separation of the elbows from address through the follow-through. By repeating the golf swing utilizing the forearm/wrist positioner 14, a trainee will, through practice, develop control and consistency necessary for a good swing. Once developed, there will be no further need for the forearm/wrist positioner.

As mentioned above, the forearm/wrist positioner 14 shown in FIGS. 1–4 relies on the trainee 10 consciously maintaining the established relationship of the elbows as the golf club 16 is moved from the address position through the follow-through position. On the other hand, a modified form of the forearm/wrist positioner 54 is shown in FIGS. 5–10 that serves to join the arms together so as to allow the trainee to maintain the proper spacing between the elbows from the address position through the follow-through without having to be aware that the outer extending leg of the spacer member is pressing against the forearm of the leading arm through the strap member 20 as is necessary with the forearm/wrist positioner 14 of FIGS. 1–4.

It will be noted that in describing the forearm/wrist positioner 54 seen in FIGS. 5–10, the parts thereof and the trainee that are identical to the parts of forearm/wrist positioner 14 and the trainee 10 of FIGS. 1–4 will be identified by corresponding reference numerals but primed.

Figure 5:
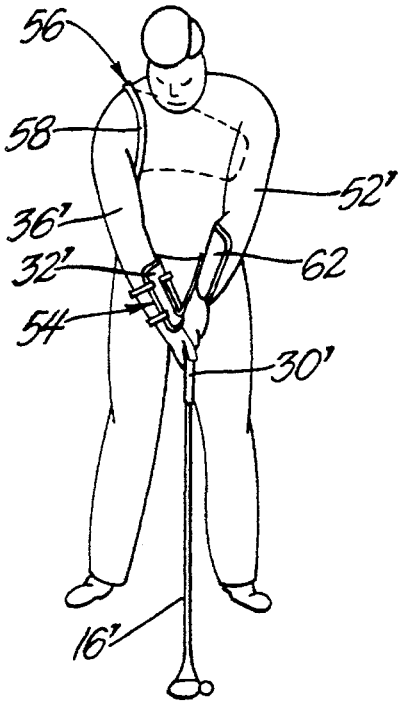
FIG. 5 is a front view of a golf trainee addressing a golf ball and having a golf swing training device which differs from that shown in FIG. 1 and which is combined with another version of a forearm/wrist positioner made in accordance with the present invention.
Figure 6:
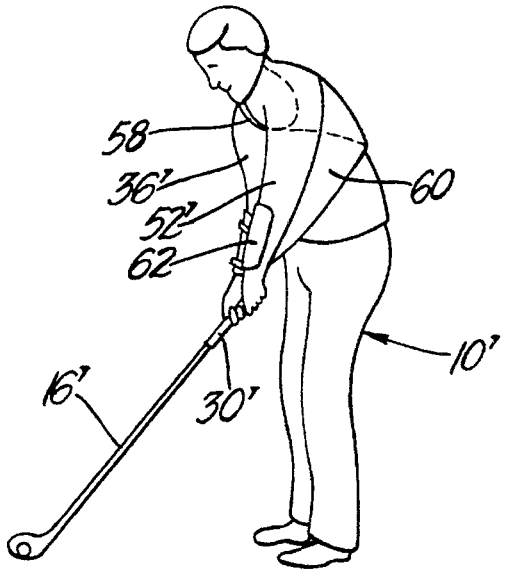
FIG. 6 is a side view of the golf trainee addressing the golf ball as seen in FIG. 5.

As seen in FIGS. 5–8, the forearm/wrist positioner 54 is shown being used by a trainee 10' who is using a golf swing training device 56 of the type that is disclosed in my patent application mentioned above. In this instance, the golf swing training device 56 includes a shoulder member 58 which takes the form of a closed loop made of a flexible inelastic material. As in the case of the golf swing training device 12 seen in FIGS. 1 and 5, the shoulder member 58 is mounted onto the upper torso of the golf trainee 10' so that the trailing arm 36' extends through the closed loop and the shoulder member 58 is positioned adjacent the deltoid muscle in a manner whereby the lower portion of the loop is located below and in contact with the trainee's arm pit and the upper portion of the loop rests on the shoulder of the trainee 10'. A strap member 60, made of a triangular piece of flexible inelastic material has its base portion fixed to the shoulder member 58 along the entire extent of the base portion and the apex portion of the strap member 60 is connected to the handle 30' of the golf club 16' through an arrangement as seen in FIG. 12. In use, the strap member 60 extends along the back of the trainee 10' and lies below the trainee's arm pit as seen in FIG. 6.

Although not shown, it will be understood that the length of the strap member 60 and the diameter of the shoulder member 58 can be adjusted in size so as to allow the golf swing training device 56 to be used with persons of different stature. As in the case of the golf training device 12 of FIGS. 1 and 2, the important consideration being that once the golf swing training device 56 is mounted on the trainee 10', the strap member 60 is taut when the trainee 10' assumes the address position of FIG. 5.

Figure 9:
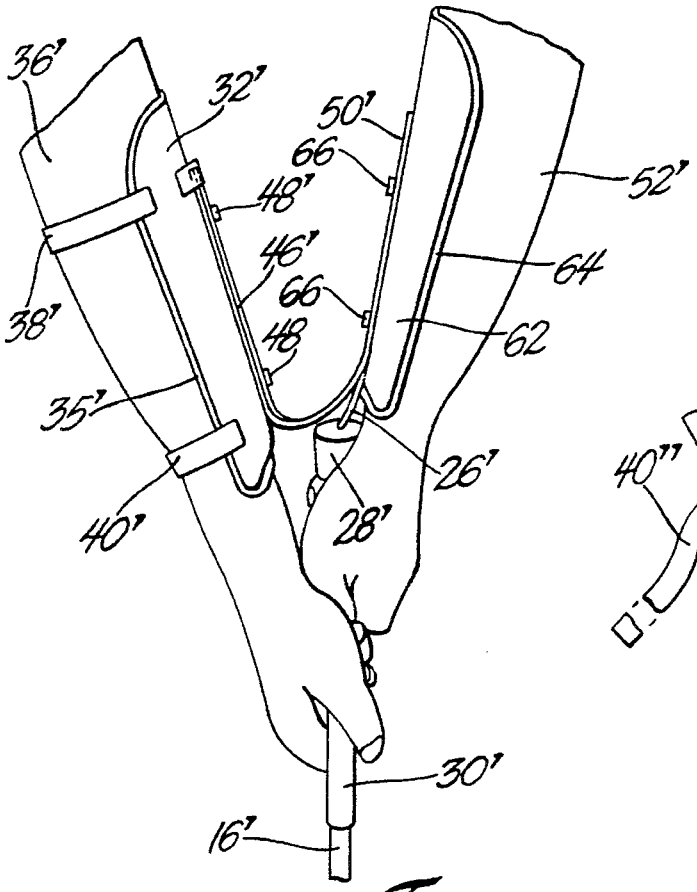
FIG. 9 is an enlarged view of the lower part of the arms of the golf trainee seen in FIG. 5 showing more clearly the manner that the modified version of the forearm/wrist positioner maintains the spaced relationship of the two forearms of the trainee.
Figure 10:
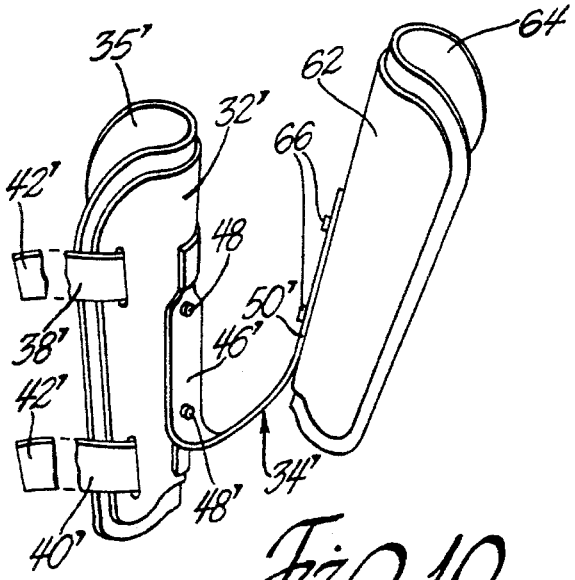
FIG. 10 is a perspective view of the forearm/wrist positioner seen in FIGS. 5–9.

As seen in FIGS. 9 and 10, the forearm/wrist positioner 54 comprises cuff members 32' and 62 and a spacer member 34'. Each of the cuff members 32' and 62 is semi-cylindrical in configuration and is provided with a cushioning member such as a felt liner or the like (35', 64). Each cuff member 32' and 62 can be molded from a plastic material to fit the tapered form of the forearms of the trainee 10'. As in the case of the forearm/wrist positioner 14 of FIGS. 1–4, the cuff member 32' includes a pair of elastic straps 38' and 40 one end of each of which is secured to one side of the cuff member 32' while the other end of each strap 38', 40' is provided with a fastener portion 42' such as VELCRO for securement with the diametrically opposed side of the cuff member 32'. The cuff member 62 is devoid of any elastic straps and is intended to be mounted on and rest on the forearm of the leading arm 52'.

The spacer member 34' is formed from a semi-rigid, malleable metal material which is generally "V" in configuration so as to provide a pair of integrally formed legs 46' and 50'. As with the spacer member 34 of the forearm/wrist positioner 14 of FIGS. 1–4, the metal thickness of the spacer member 34' should be such that the angle between the legs 46' and 50' can be adjusted by manually forceably moving the legs either towards each other or away from each other so that once preset for the trainee 10', the spacer member 34' maintains a predetermined angularity between the forearms during use by the trainee 10'.

The leg 46' of the spacer member 34' is rigidly secured, as by rivets 48' or the like, along its length to the cuff member 32' along the longitudinal axis thereof. The other arm 50' is secured to the other cuff member by similar fasteners 66. Also, the interconnecting attachment of the spacer member 34' to the cuff members 32' and 62 is such that the cuff member 62, which is mountable on the leading arm 52' of the trainee 10', is located slightly higher than the cuff member 32' which is mountable on the trailing arm 36' of the trainee 10'. This allows the trainee to use the interlocking hand grip used by most golfers on the golf club handle 30' wherein the leading arm hand is positioned at a level higher than the trailing arm hand when in the address position.

In use, the forearm/wrist positioner 54 is mounted on the forearms of the trainee 10' as seen in FIGS. 5 and 9 with the angle of the arms 36' and 52' being set at a predetermined angle depending upon the stature of the trainee 10' when in the address position. It has been suggested that the proper angle can be determined by having the elbows pointing to the hipbones with the "pocket" of each elbow (small depression on the inside of the joint) facing the sky. In this position the distance between the forearms and the elbows of the trainee 10' will be set.

Figure 7:
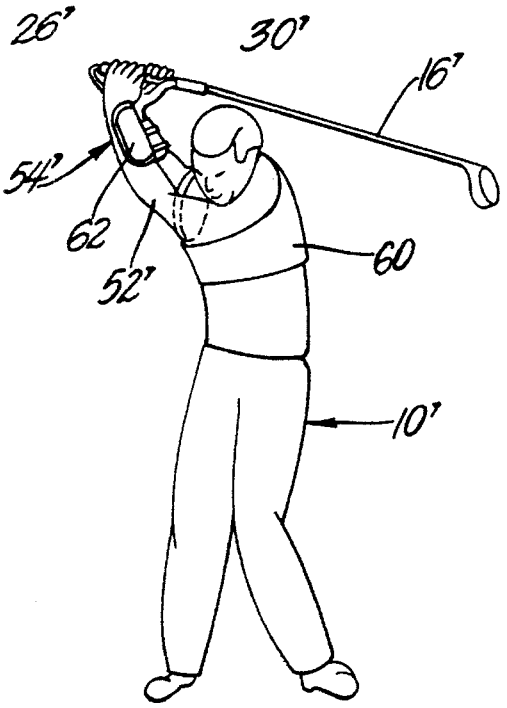
FIG. 7 is a front view of the golf trainee of FIGS. 5 and 6 in the backswing position.
Figure 8:
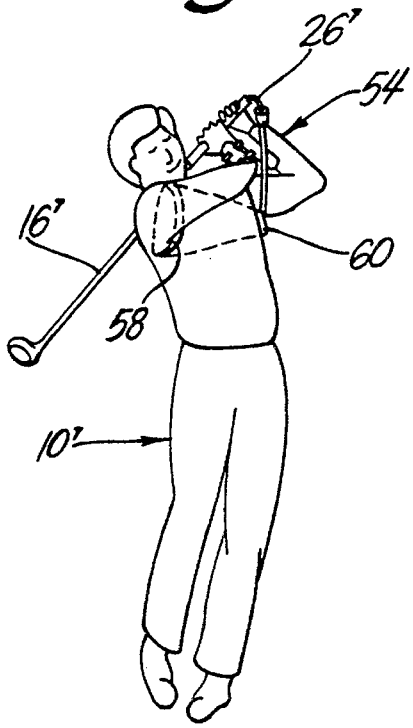
FIG. 8 of a side view of the golf trainee of FIGS. 5–7 in the follow-through position.

As the trainee 10' moves the golf club 16' to the backswing position of FIG. 7, the forearm/wrist positioner 54 will maintain the proper distance between the elbows while at the same time allowing the wrists to cock at the top of the backswing. Moreover, at the top of the backswing, bending of the elbow of the trailing arm 36' will be permitted by the fact that the cuff member 62 merely rests against the forearm and is not secured thereto. Similarly, the non-secured engagement of the cuff member 62 with the forearm of the leading arm will also compensate for the bending of the elbows at the top of the follow-through seen in FIG. 8.

Figure 11:
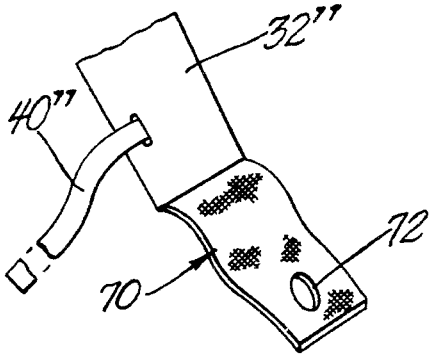
FIG. 11 shows the cuff portion of the forearm/wrist positioner seen in FIGS. 1–4 fitted with thumb retainer.

FIG. 11 shows another form of the forearm/wrist positioner shown in FIG. 1–4. In this instance, the parts seen in FIG. 11 that are identical to the parts of the forearm/wrist positioner of FIGS. 1–4 are identified by the same reference numerals but are provided with a double prime.

As seen in FIG. 11, the lower end of the cuff member 32" only is shown and has rigidly secured thereto a thumb retainer 70 which can be made of leather or a vinyl material, or any other tough, flexible material. The retainer 70 is formed with an oval or circular opening 72 through which the thumb of the trainee 10 can extend for maintaining the cuff member 32" from moving longitudinally along the arm of the trainee.

Although both of the forearm/wrist positioners seen in FIGS. 1–4 and FIGS. 5–10 are shown combined with torso mounted golf swing training devices, it should be apparent that each of the forearm/wrist positioners 14 and 54 can be used by a trainee without any form of a torso mounted golf swing training device. This would be particularly true if the trainee has already developed a relatively good swing but only needs improvement in the position of the arms and elbows for achieving a further improved swing.

It will also be understood that rather than using straps 38 and 40 with the forearm/wrist positioner of FIGS. 1–4 or the forearm/wrist positioner of FIG. 5–10, one could substitute an elastic band which would permanently connect the opposed sides of the cuff member. With this arrangement, the trainee would merely slip his hand into the opening between the inner portion of the cuff member and elastic band and manually pull the cuff member upwardly into engagement with his/her forearm with the elastic band providing the necessary force and pressure to hold the cuff member in the preset position on the associated forearm.

It will also be understood that the entire forearm/wrist positioner of FIGS. 1–4 and FIGS. 5–10 can be made of plastic material as a single molded article. In this manner, a separate spacer member would not be necessary inasmuch as it would become an integral part of the cuff member 32 seen in FIGS. 1–4 and an integral part of the cuff members 32' and 62 seen in FIGS. 5–10.

Various changes and modifications can be made in the construction of this forearm/wrist positioner without departing from the spirit of the invention. Such changes and modifications are contemplated by the inventor and, therefore, he does not wish to be limited except by the scope of the appended claims.

The embodiments of the invention in which an exclusive property or privilege is claimed are defined as follows:

1. A forearm/wrist positioner which maintains a predetermined triangular relationship between the forearms of a leading arm and a trailing arm of a trainee as the trainee swings a golf club from the address position to the backswing, downswing, and follow-through positions, said forearm/wrist positioner comprising a cuff member adapted to be mounted on one of said forearms of said trainee, a spacer member having one end thereof fastened to said cuff member and adapted to have the other end thereof extend towards and be pressed by said one of said forearms against said other of said forearms of the trainee for maintaining said predetermined triangular relationship between said forearms while allowing relative movement between said other end and said one of said forearms as the trainee swings the golf club from said address position through said follow-through position, said spacer member being made of a malleable material as a single unitary member which allows the size of the included angle between the forearms of the trainee to be adjusted by manually forcibly moving one end of said spacer member relative to said other end, and means for maintaining said cuff member on said one of said forearms in a substantially fixed position while allowing said relative movement between said other end of said spacer member and said other forearm as said golf club is swung from said address position through said follow-through position.

2. The forearm/wrist positioner set forth in claim 1 wherein said means for maintaining said cuff member on said one of said forearms takes the form of strap means connected to said cuff member.

3. The forearm/wrist positioner set forth in claim 2 wherein said means for maintaining said cuff member on said one of said forearms includes a thumb retainer attached to said cuff member to prevent longitudinal movement of said cuff member relative to said one of said forearms.

4. The forearm/wrist positioner set forth in claim 1 combined with a golf swing training device which serves to act as a constraint on the path of movement of said golf club as the trainee swings the golf club from said address position through said follow-through position, said golf swing training device including a portion adapted to be mounted on the torso of said trainee, and a strap connected to said portion and adapted to be connected to the handle of said golf club.

5. The combination set forth in claim 4 wherein said portion adapted to be mounted on said torso takes the form of a closed loop adapted to be connected to said trailing arm at the shoulder of the trainee and said strap is fastened to said closed loop.

6. The combination set forth in claim 5 wherein said strap is adapted to extend along the back of said torso and below the armpit of the leading arm for connection with said handle of said golf club.

7. A forearm/wrist positioner which maintains a predetermined triangular relationship between the pair of forearms of a trainee as the trainee swings a golf club from the address position to the backswing, downswing, and follow-through positions, said forearm/wrist positioner comprising a first cuff member adapted to be mounted on one of said pair of forearms, a second cuff member adapted to be mounted on the other of said pair of forearms and be movable relative thereto, a spacer member having one end thereof fastened to said first cuff member and having the other end thereof fastened to said second cuff member for maintaining said predetermined triangular relationship between said pair of forearms of said trainee as the trainee swings the golf club from said address position through said follow-through position, said spacer member being made of a malleable material as a single unitary member which allows the size of the included angle between said pair of forearms of the trainee to be adjusted by manually forcibly moving said one end of said spacer member relative to said other end, and means for maintaining said first cuff member on said one of said pair of forearms in a substantially fixed position while allowing said second cuff member to move relative to said other of said pair of forearms as said golf club is swung from said address position through said follow-through position.

8. A forearm/wrist positioner which maintains a predetermined triangular relationship between the forearms of a leading arm and a trailing arm of a trainee as the trainee swings the golf club from the address position to the backswing, downswing, and follow-through positions, said forearm/wrist positioner comprising a first cuff member adapted to be mounted on the forearm of said trailing arm, a second cuff member adapted to be mounted on the forearm of said leading arm and be movable relative thereto, a spacer member having a V-shaped configuration and consisting of a pair of legs one of which is connected to said first cuff member and the other of which is connected to said second cuff member for maintaining said predetermined triangular relationship between the forearms and the elbows of said leading arm and said trailing arm of said trainee as the trainee swings the golf club from said address position through said follow-through position, said spacer member being made of a malleable material which allows the size of the included angle between said pair of legs to be adjusted by manually forcibly bending said one of said legs relative to said other of said legs at the intersection of said pair of legs, and means for maintaining said one of the cuff members on its associated forearm in a substantially fixed position while allowing the other of the cuff members to move relative to its associated forearm as said golf club is swung from said address position through said follow-through position.

9. A forearm/wrist positioner which maintains a predetermined triangular relationship between the forearms of a leading arm and a trailing arm of a trainee as the trainee swings the golf club from the address position to the backswing, downswing, and follow-through positions, said forearm/wrist positioner comprising a first cuff member adapted to be mounted on the forearm of said trailing arm, a second cuff member adapted to be mounted on the forearm of said leading arm and be movable relative thereto, a spacer member having a V-shaped configuration and consisting of a pair of legs one of which is connected to said first cuff member and the other of which is connected to said second cuff member for maintaining said predetermined triangular relationship between the forearms and the elbows of said leading arm and said trailing arm of said trainee as the trainee swings the golf club from said address position through said follow-through position, said spacer member being made of a malleable material which allows the size of the included angle between said pair of legs to be adjusted by manually forcibly bending said one of said legs relative to said other of said legs at the intersection of said pair of legs, and means connected to said first cuff member for securing said first cuff member to said forearm of said trailing arm so as to maintain said first cuff member in a substantially fixed position on its associated forearm while allowing said second cuff member to move relative to said forearm of said leading arm as said golf club is swung from said address position through said follow-through position, said first cuff member and said second cuff member each being semi-cylindrical in configuration and being molded from a plastic material so as to generally conform to the shape of the associated forearm.

* * * * *